US007617876B2

(12) United States Patent
Patel et al.

(10) Patent No.: US 7,617,876 B2
(45) Date of Patent: Nov. 17, 2009

(54) FORMATION ISOLATION VALVE AND METHOD OF USE

(75) Inventors: Dinesh R. Patel, Sugar Land, TX (US); David A. Hill, Kirksville, MO (US); Jabus T. Davis, Katy, TX (US); David T. Lamont, St. Margaret (GB); Charles D. Harding, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/033,416

(22) Filed: Feb. 19, 2008

(65) Prior Publication Data

US 2008/0135225 A1 Jun. 12, 2008

Related U.S. Application Data

(63) Continuation of application No. 10/364,585, filed on Feb. 11, 2003, now Pat. No. 7,347,272.

(60) Provisional application No. 60/356,496, filed on Feb. 13, 2002.

(51) Int. Cl.

| | |
|---|---|
| ***E21B 34/06*** | (2006.01) |
| ***E21B 34/10*** | (2006.01) |
| ***E21B 34/14*** | (2006.01) |

(52) U.S. Cl. ..... 166/373; 166/322; 166/332.3; 166/332.5; 166/334.2

(58) Field of Classification Search ..... 166/373, 166/374, 322, 50, 334.2, 332.2–332.5
See application file for complete search history.

(56) References Cited

U.S. PATENT DOCUMENTS

| | | | | |
|---|---|---|---|---|
| 5,810,087 | A * | 9/1998 | Patel | 166/373 |
| 6,041,864 | A * | 3/2000 | Patel et al. | 166/332.4 |
| 6,328,112 | B1 * | 12/2001 | Malone | 166/386 |
| 6,330,913 | B1 * | 12/2001 | Langseth et al. | 166/250.01 |
| 2001/0035288 | A1 * | 11/2001 | Brockman et al. | 166/65.1 |

* cited by examiner

*Primary Examiner*—Giovanna C Wright
(74) *Attorney, Agent, or Firm*—Daryl Robert Wright; James L. Kurka

(57) ABSTRACT

The present invention provides for high volume flow from a well. A retrievable formation isolation valve allows high volume flow through the remaining casing or tubing. Alternatively, a large bore valve configuration that is not retrieved, but remains as part of the casing, can be used. The present invention also includes methods to allow for high volume flow using retrievable isolation valves or large bore valves.

26 Claims, 4 Drawing Sheets

FORMATION ISOLATION VALVE AND METHOD OF USE

This is a continuation of U.S. patent application Ser. No. 10/364,585, entitled "FORMATION ISOLATION VALVE AND METHOD OF USE," filed on Feb. 11, 2003, which claims the benefit of U.S. Provisional Application 60/356,496 filed Feb. 13, 2002.

BACKGROUND

The present invention pertains to isolation valves used in subsurface wells, and particularly to retrievable and large bore formation isolation valves.

It is often desirable to isolate a portion of a well. For example, a portion of the well may be isolated during insertion or retrieval of a drill string. It may also be desirable to isolate a portion of a well during perforation operations, particularly during underbalanced completion operations. There are several devices and methods available to perforate a formation using underbalanced completion operations. Those include using special connectors such as "Completion Insertion and Retrieval under Pressure" connectors, placing formation isolation valves in the completion, and using wireline or coil tubing. However, each of those options has shortcomings, and none of those methods or devices allow, in the case of multiple production zones, flowing each zone individually for clean up and testing. Therefore, there is a continuing need for improved isolation devices.

SUMMARY

The present invention provides for high volume flow from a well. A retrievable formation isolation valve allows high volume flow through the remaining casing or tubing. Alternatively, a large bore valve configuration that is not retrieved, but remains as part of the casing, can be used. The present invention also includes methods to allow for high volume flow using retrievable isolation valves or large bore valves.

Advantages and other features of the invention will become apparent from the following drawing, description and claims.

DETAILED DESCRIPTION

Figure 1:
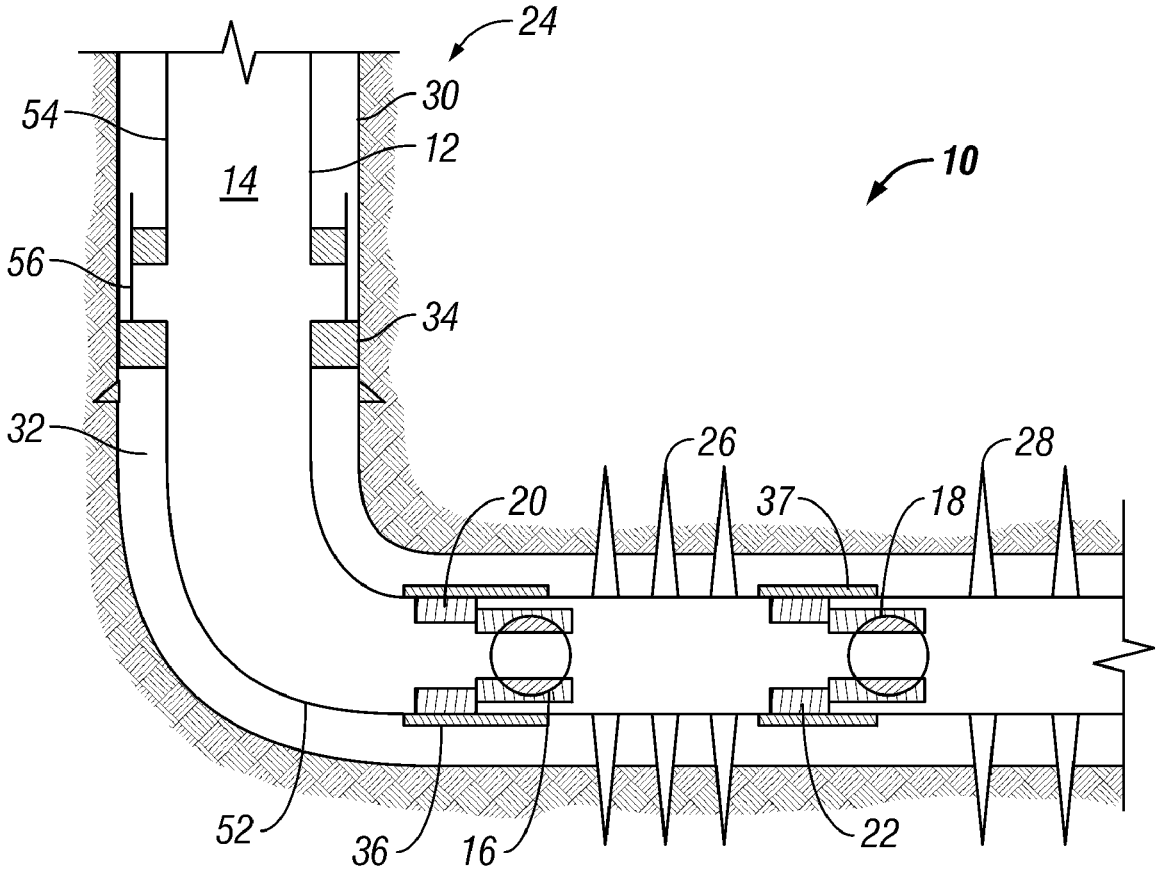
FIG. 1 is a schematic diagram of a completion assembly constructed in accordance with the present invention.

Referring to FIG. 1, a completion assembly 10 comprises a production tubing 12 having an interior passageway 14 in which a downstream formation isolation valve 16 and an upstream formation isolation valve 18 are disposed. Formation isolation valve 16 sealingly mounts to tubing 12 using downstream seal assembly 20, and formation isolation valve 18 sealingly mounts to tubing 12 using upstream seal assembly 22. When closed, each valve 16, 18 isolates that portion of passageway 14 that is downstream of that particular isolation valve from the upstream portion of passageway 14.

Production tubing 12 is shown disposed in a wellbore 24 having multiple production zones 26, 28. Production zone 26 is downstream of production zone 28. In this description, flow is assumed to go from production zones 26, 28 to the surface. Thus, upstream means in a direction opposite the flow and downstream means in the direction of the flow. Formation isolation valve 16 is mounted downstream of production zone 26, and formation isolation valve 18 is mounted downstream of production zone 28, but upstream of zone 26. Wellbore 24 may or may not have a casing 30 mounted therein, or casing 30 may extend in only a portion of wellbore 24. The annular region 32 between tubing 12 and casing 30, or wellbore 24 if casing 30 is not present, is sealed by a packer 34. Packer 34 isolates the downstream portion of annular region 32, relative to packer 34, from the upstream portion.

FIG. 1 shows index couplings 36, 37 along predetermined sections of tubing 12. Index couplings 36, 37 are used to properly locate valves 16, 18 relative to production zones 26, 28. Index couplings are well known and explained by Ohmer in U.S. Pat. No. 5,996,711.

Figure 2:
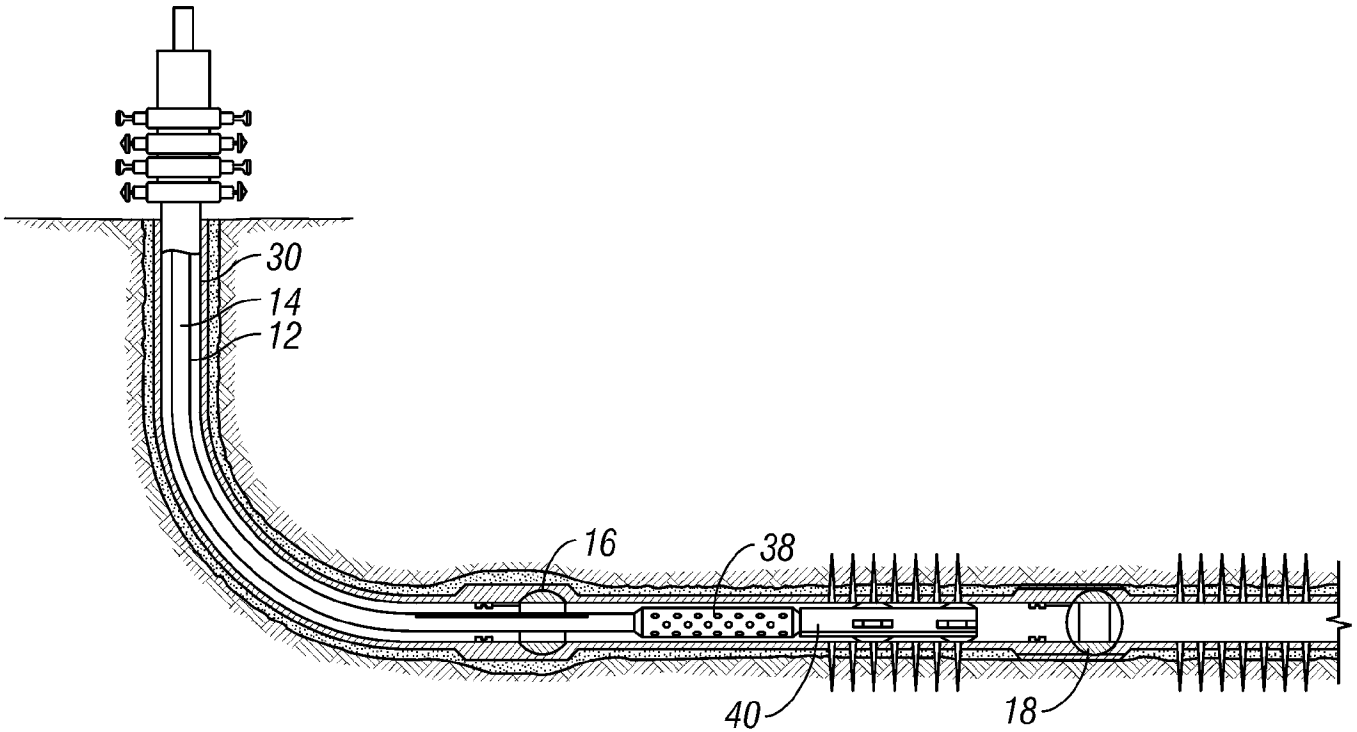
FIG. 2 is a schematic diagram of an alternative embodiment of a completion assembly constructed in accordance with the present invention.

FIG. 2 shows an alternative embodiment in which formation isolation valves 16, 18 are run in with casing 30 and cemented in place to become integral with casing 30. That allows the use of a larger bore formation isolation valve than is possible when the isolation valve is mounted in the interior passageway 14 of tubing 12. In the embodiment of FIG. 2, tubing 12 has a perforating gun 38 attached to the upstream end of tubing 12 and an actuator 40 attached to the upstream end of gun 38. In this case, actuator 40 is a shifting tool. The larger bore of valves 16, 18 permit tubing 12, gun 38, and actuator 40 to pass through valves 16, 18, when open.

Figure 3:
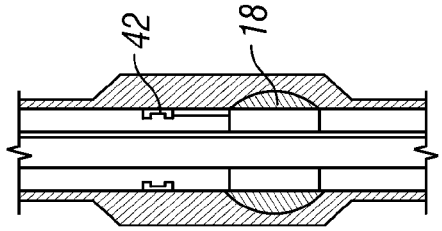
FIG. 3 is an enlarged view of a valve shown in the completion assembly of FIG. 2.

FIG. 3 provides a more detailed view of formation isolation valve 18. Formation isolation valve 18 is a ball valve. In the embodiment of FIG. 2, valve 16 is also a ball valve. FIG. 3 also shows a valve operator 42. Valve operator 42 is a mechanical link that responds to (shifting tool) actuator 40 to open or close the valve. Valve 16 has a similar valve operator 42. Though shown as ball valves, formation isolation valves 16, 18 are not restricted to ball valves. Nor are they restricted to a particular type of valve operator, or even to a single type of valve operator. For example, valve operator 42 can be a hydraulic, pneumatic, or electromechanical device. Actuator 40 for such valve operators may be pressure applied within the annulus or tubing, a hydraulic, pneumatic, electrical, or fiber optic control line, pressure pulse signals transmitted to a receiver, or a rupture disk.

Figure 4:
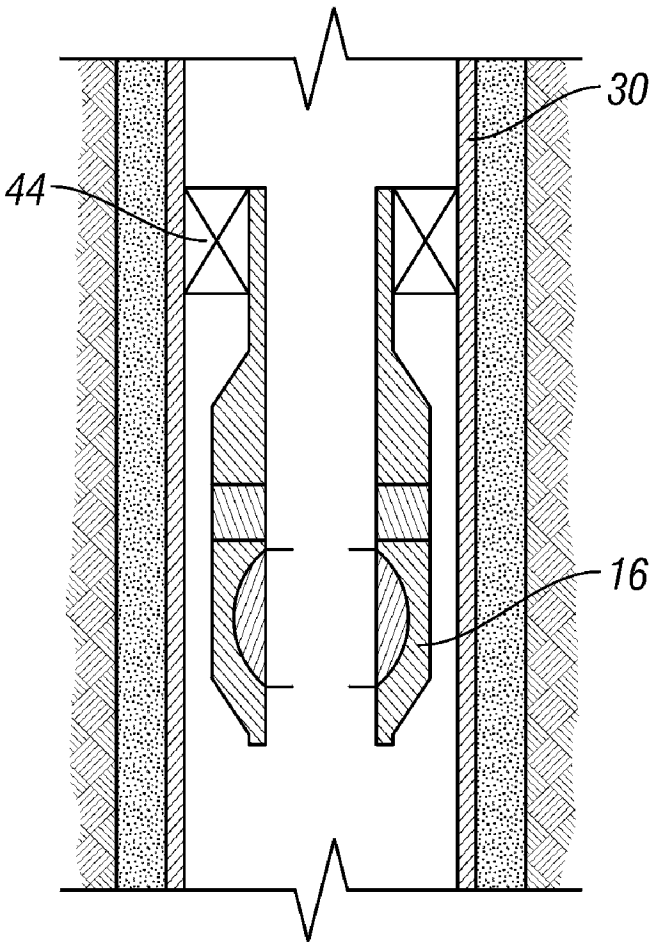
FIG. 4 is a schematic diagram of an alternative embodiment of a completion assembly constructed in accordance with the present invention.

Instead of being cemented in place as in FIG. 2, valves 16, 18 can also be temporarily sealed in place inside casing 30. FIG. 4 shows valve 16 suspended from a removable packer 44. If removable packer 44 is used, valves 16, 18 are sized to allow tubing 12 to pass through open valves 16, 18. Removable packer 44 can be, for example, a retrievable packer, as disclosed by Allen in U.S. Pat. No. 3,976,133, a cup packer, as disclosed by Hutchison in U.S. Pat. No. 4,385,664, or an inflatable packer, as disclosed by Sanford, et al in U.S. Pat. No. 4,768,590. Removable packer 44, by design, can be set in place to form a temporary seal, and then released and retrieved at will. There are various designs and the present invention is not limited to the examples referred to in this paragraph.

Figure 6:
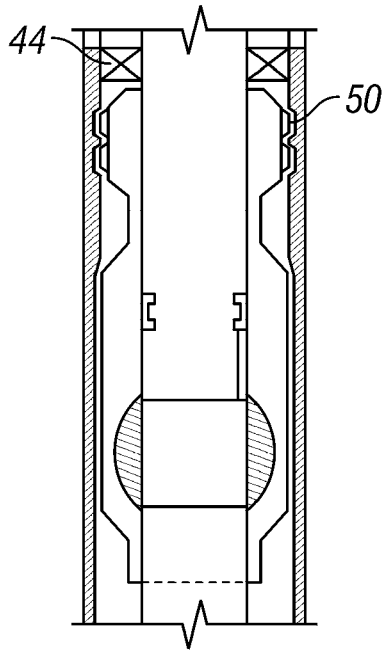
FIG. 6 is an enlarged view of a valve shown in the completion assembly of FIG. 5.

A similar arrangement can be placed inside tubing 12 instead of casing 30. This would produce an embodiment similar to that of FIG. 1, but removable packers 44 would effectively replace index couplings 36, 37 and seal assemblies 20, 22. Alternatively, seal bores (similar to a polished bore receptacle 56 shown in FIG. 1), in conjunction with selective profiles 50 (FIG. 6) or collets (not shown) may be used to position and seal valves 16, 18 inside tubing 12. Therefore, one aspect of the present invention is a retrievable isolation valve that can be selectively opened and closed (e.g., a ball valve), and that can be temporarily set in a tubing or other well conduit.

Figure 5:
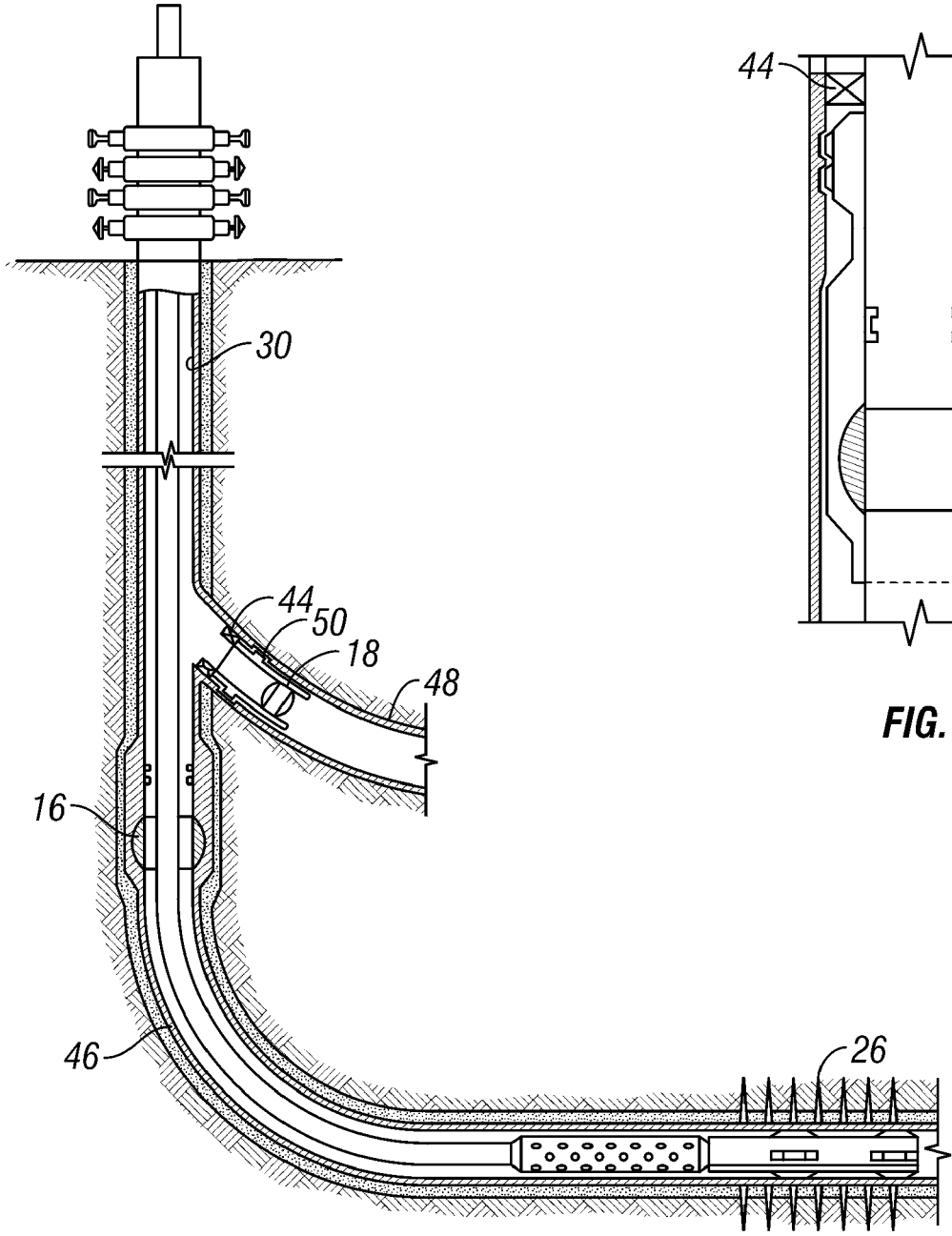
FIG. 5 is a schematic diagram of an alternative embodiment of a completion assembly constructed in accordance with the present invention.

FIG. 5 shows the use of formation isolation valves 16, 18 in a multilateral application. Valve 16 is placed in a main bore 46 of wellbore 24 and valve 18 is placed in a lateral branch 48. In the embodiment shown, valve 16 is cemented in place with casing 30, as described above. Valve 16 is a large bore valve allowing high volume flow. Valve 18 is set in place using a selective profile 50 (see FIG. 6) to properly locate it within lateral branch 48. Valve 18 is set below a removable packer 44 to seal lateral branch 48 from main bore 46. Valve 18 and packer 44 can be removed to permit high volume flow through the full bore of branch 48.

To operate completion assembly 10 of FIG. 1 to perform perforation operations, for example, an upstream portion 52 of tubing 12 is run in wellbore 24 such that it extends from the bottom of casing 30 past the most upstream production zone 28. In this embodiment, tubing 12 is made of various sections joined as tubing 12 is lowered into wellbore 24. Upstream portion 52 of tubing 12 is often referred to as a liner and can be cemented in place in wellbore 24. A downstream portion 54 of tubing 12 is joined to upstream portion 52 using, for example, a polished bore receptacle 56. Packer 34 is shown just upstream of polished bore receptacle 56 in FIG. 1.

Index couplings 36, 37 are incorporated into tubing 12 such that they are properly positioned relative to production zones 26, 28 when upstream portion 52 of tubing 12 is properly set into wellbore 24. Formation isolation valve 18, along with upstream seal assembly 22, is run in and sealingly secured to upstream index coupling 37. Valve 18 would normally be run into the well in the open position, but it could be run in closed and actuated open. Gun 38 and actuator 40 are run in through valve 18 and gun 38 is fired. After perforating is completed, gun 38 and actuator 40 are extracted, with actuator 40 closing valve 18 as it passes valve operator 42. That isolates perforated zone 28. Valve 18 can be opened to allow zone 28 to flow to remove debris, and then closed again to isolate zone 28.

Formation isolation valve 16, along with downstream seal assembly 20, is then run in and sealingly secured to downstream index coupling 36. Gun 38 and actuator 40 are run in through valve 16 and gun 38 is fired. After perforating is completed, gun 38 and actuator 40 are extracted, with actuator 40 closing valve 16 as it passes valve operator 42. That isolates perforated zone 26. Valve 16 can be opened to allow zone 26 to flow to remove debris, and then closed again to isolate zone 26. Then, valves 16, 18 are pulled out of the well, as described below, to present the unrestricted, large inner diameter of tubing 12 for high rate flow.

Valves 16, 18 can be removed in various ways. The release elements described in this paragraph are known in the art and not shown in the figures of this specification. In the embodiment of FIG. 1, index coupling 36, for example, can have a sliding sleeve to shear connecting pins securing seal assembly 20 to coupling 36, and a "fishing" tool can retrieve the released components. Similarly, the blended embodiment of FIGS. 1 and 4, in which removable packer 44 effectively replaces seal assemblies 20, 22 and index couplings 36, 37, can be retrieved because of the design of the packer itself. Valves 16, 18 could also be set using keys, for example, so that valves 16, 18 could be milled.

Operation of the embodiment of FIG. 4 is similar to that of FIG. 1. A first removable packer 44, with formation isolation valve 18, is set downstream of zone 28. Gun 38 and actuator 40 are run in on tubing 12 through valve 18 and gun 38 is fired. After perforating is completed, gun 38 and actuator 40 are extracted, and actuator 40 closes valve 18 to isolate perforated zone 28. Valve 18 can be opened to allow zone 28 to flow, and then closed again to isolate zone 28. A second removable packer 44, with formation isolation valve 16, is set downstream of zone 26. Gun 38 and actuator 40 are run in on tubing 12 through valve 16 and gun 38 is fired. After perforating is completed, gun 38 and actuator 40 are extracted, with actuator 40 closing valve 16 to isolate perforated zone 26. Valve 16 can be opened to allow zone 26 to flow, and then closed again to isolate zone 26. Then, valves 16, 18 are pulled out of the well, as described above, to present the unrestricted, large inner diameter of casing 30 or tubing 12, set with a packer 34, for high rate flow.

In other embodiments, such as that of FIG. 2, valves 16, 18 need not be removed. Because valves 16, 18 are set in casing 30, they are sized to accommodate the full bore of tubing 12.

Operation of the embodiment of FIG. 2 is essentially the same as for the embodiment of FIG. 1, except valves 16, 18 are set in casing 30 instead of tubing 12. Casing 30 is assembled with valves 16, 18 placed so that they are properly positioned relative to zones 26, 28 when casing 30 is set and cemented in place. Gun 38 and actuator 40 are run in through valve 18 and gun 38 is fired. After perforating is completed, gun 38 and actuator 40 are extracted, with actuator 40 closing valve 18 as it passes valve operator 42. That isolates perforated zone 28. Valve 18 can be opened to allow zone 28 to flow, and then closed again to isolate zone 28.

Gun 38 and actuator 40 are then run in through valve 16 and gun 38 is fired. After perforating is completed, gun 38 and actuator 40 are extracted, with actuator 40 closing valve 16 as it passes valve operator 42. That isolates perforated zone 26. Valve 16 can be opened to allow zone 26 to flow, and then closed again to isolate zone 26. Valves 16, 18 can then be actuated open to allow production through casing 30, or tubing 12 can be run in, with a packer 34 set downstream of valve 16 to seal annular region 32. Tubing 12 would allow well fluid to be produced through passageway 14.

The embodiment of FIG. 5 would be operated similarly. Each zone 26, 28 could be perforated and "flowed" in isolation from the other zone. Those valves that are removable can be removed to provide for high rate flow. Those valves that remain in place are sized to accommodate high volume flow.

Figure 7:
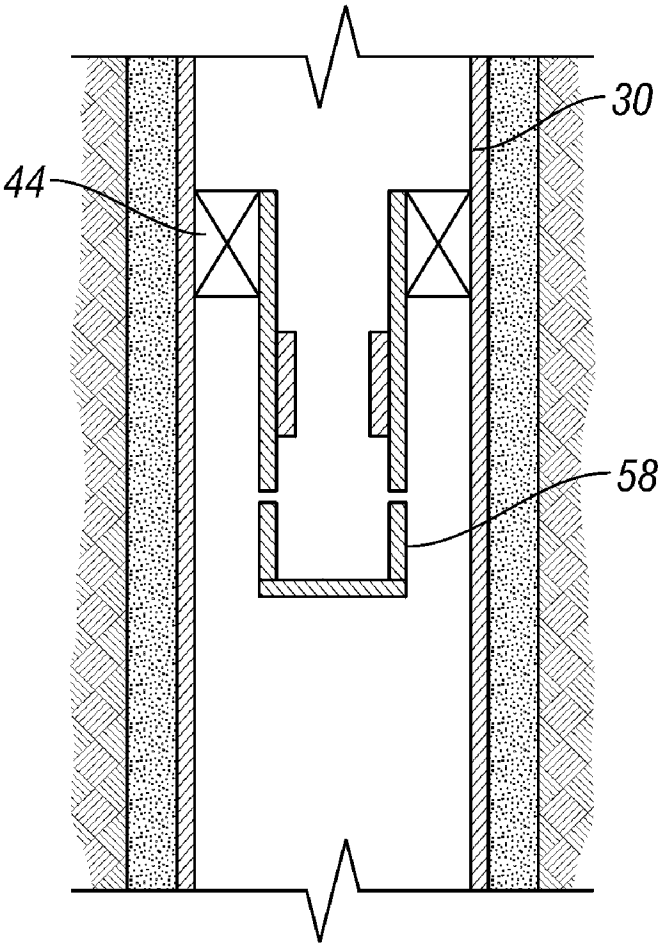
FIG. 7 is a schematic diagram of a flow controller used in accordance with the present invention.

The present invention overcomes the shortcomings mentioned in the Background section of this specification, as well as others not specifically highlighted. In particular, perforating long sections with specialized connectors or coil tubing takes a long time, and using formation isolation valves in a conventional manner does not provide a large inner diameter for a high production rate. The present invention includes various apparatus and methods to achieve high volume flow rates subsequent to performing desired completion operations. The present invention also allows placement of other devices, such as a flow controller 58 (FIG. 7), either after performing initial operations or during a later intervention.

Although only a few example embodiments of the present invention are described in detail above, those skilled in the art will readily appreciate that many modifications are possible in the example embodiments without materially departing from the novel teachings and advantages of this invention.

Accordingly, all such modifications are intended to be included within the scope of this invention as defined in the following claims. It is the express intention of the applicant not to invoke 35 U.S.C. .sctn. 112, paragraph 6 for any limitations of any of the claims herein, except for those in which the claim expressly uses the words 'means for' together with an associated function.

What is claimed is:

1. A completion assembly for use in a well having a main bore and a lateral bore, the completion assembly comprising:

a first conduit having an interior passageway and being located in the lateral bore;

a first valve located in the lateral bore, the first valve being sealingly and remove ably mounted to the first conduit in the interior passageway and the first valve being capable of opening and closing multiple times; and a second valve sealingly and remove ably mounted to the first conduit in the interior passageway, the second valve being capable of opening and closing multiple times, wherein the first valve is placed downstream of a first formation, the second valve is placed downstream of a second formation and upstream of the first formation and a second conduit other than the first conduit does not connect the first and second valves.

2. The completion assembly of claim 1, wherein the second valve is located in the lateral bore.

3. The completion assembly of claim 1 in which the first valve is a ball valve.

4. The completion assembly of claim 1 further comprising an actuator.

5. The completion assembly of claim 4 in which the actuator is a shifting tool.

6. The completion assembly of claim 4 in which the actuator is a pressure pulse signal.

7. The completion assembly of claim 4 in which the actuator is an applied pressure.

8. The completion assembly of claim 4 in which the actuator is a hydraulic, pneumatic, electrical, or fiber optic control line.

9. The completion assembly of claim 4 in which the first valve has a first valve operator to open and close the first valve in response to the actuator.

10. The completion assembly of claim 1 in which the second valve is a ball valve.

11. The completion assembly of claim 1 further comprising an actuator to selectively open and close the first and second valves.

12. The completion assembly of claim 11 in which the actuator is a shifting tool.

13. The completion assembly of claim 11 in which the actuator is a pressure pulse signal.

14. The completion assembly of claim 11 in which the actuator is an applied pressure.

15. The completion assembly of claim 11 in which the actuator is a hydraulic, pneumatic, electrical, or fiber optic control line.

16. The completion assembly of claim 11 in which the first valve has a first valve operator to open and close the first valve in response to the actuator and the second valve has a second valve operator to open and close the second valve in response to the actuator.

17. The completion assembly of claim 1 in which the first valve is placed in a branch of a multilateral well.

18. A system comprising:

a casing having an interior passageway and disposed in a bore to line and support the bore; and a ball valve directly mounted to the casing inside the interior passageway of the casing, the ball valve registering with the interior passageway when the ball valve is open so that a cross-sectional flowpath through the valve when the valve open is substantially the same as a cross-sectional flowpath through the casing near the valve, the ball valve being capable of opening and closing multiple times;

wherein the ball valve is part of the casing and at least the ball valve part of the casing is cemented in the well.

19. The isolation system of claim 18 further comprising an actuator to open and close the ball valve.

20. The isolation system of claim 18 further comprising a second valve mounted to the casing and in registry with the interior passageway when the second valve is open, the second valve being capable of opening and closing multiple times.

21. The isolation system of claim 20 further comprising a tubing, the tubing being able to pass through the open ball valve and the second valve.

22. The isolation system of claim 20 further comprising an actuator to selectively open and close the ball valve and the second valve.

23. The isolation system of claim 22 in which the actuator is a shifting tool.

24. The isolation system of claim 22 in which the actuator is an applied pressure.

25. The isolation system of claim 22 in which the actuator is a hydraulic, pneumatic, electrical, or fiber optic control line.

26. The isolation system of claim 22 in which the ball valve has a ball valve operator, and the second valve has a second valve operator, each valve operator independently opening or closing its respective valve in response to the actuator.

* * * * *